US006263769B1

(12) United States Patent
Macor

(10) Patent No.: US 6,263,769 B1
(45) **Date of Patent: *Jul. 24, 2001**

(54) OPEN END WRENCH WITH PINCH-LOCKING ENGAGING SURFACES

(75) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/565,737

(22) Filed: May 8, 2000

(51) Int. Cl.[7] ..... B25B 13/02
(52) U.S. Cl. ..... 81/119; 81/186
(58) Field of Search ..... 81/119, 186, 124.4, 81/121.1

(56) References Cited

U.S. PATENT DOCUMENTS 4,776,244 * 10/1988 Olson et al. ..... 81/119
5,284,073 * 2/1994 Wright et al. ..... 81/186 X
5,878,636 * 3/1999 Baker ..... 81/186 X
6,082,228 * 7/2000 Macor ..... 81/119

* cited by examiner

*Primary Examiner*—James G. Smith

(57) ABSTRACT

An open end wrench head is described for use with a fastener which has at least two substantially parallel outer engaging surfaces that create an across-width dimension. The wrench head has an orifice which comprises six principle internal engaging surfaces each being substantially flat and positioned around an imaginary central axis. The first, second and third internal engaging surfaces are positioned on a first jaw, and the fourth, fifth and sixth internal engaging surfaces are positioned on a second opposing jaw. The first internal engaging surface is positioned closer to the open end than the second internal engaging surface and diverges outward from the imaginary central axis. The second internal engaging surface is positioned closer to the open end than the third internal engaging surface and is substantially parallel to the imaginary central axis. The third internal engaging surface diverges outward from the imaginary central axis. The fourth internal engaging surface is positioned crosswise opposing the first internal engaging surface and diverges outward from the imaginary central axis. The fifth internal engaging surface is positioned crosswise opposing the second internal engaging surface and is substantially parallel the imaginary central axis. The sixth internal engaging surface is positioned crosswise opposing the third internal engaging surface and diverges outward from the imaginary central axis. The second and fifth internal engaging surfaces are spaced apart by a dimension slightly greater than the across-width dimension of the fastener. The first and sixth internal engaging surfaces are spaced apart by a dimension slightly less than the across-width dimension of the fastener and the third and forth internal engaging surfaces are spaced apart by a dimension slightly less than the across-width dimension of the fastener.

20 Claims, 4 Drawing Sheets

FIG. 4
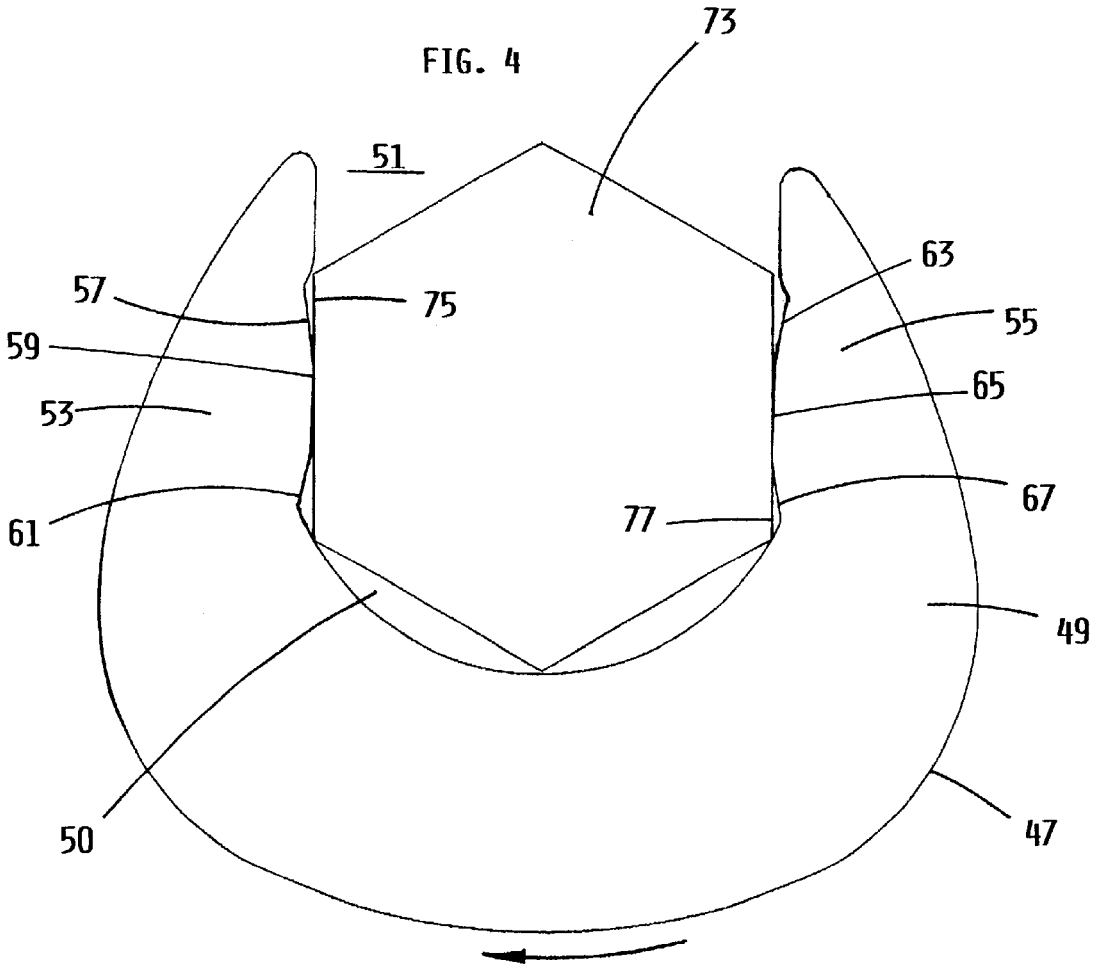
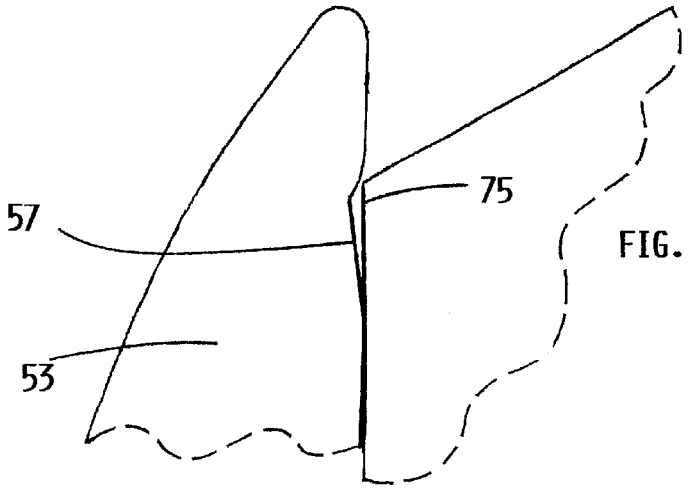
FIG. 5

FIG. 6
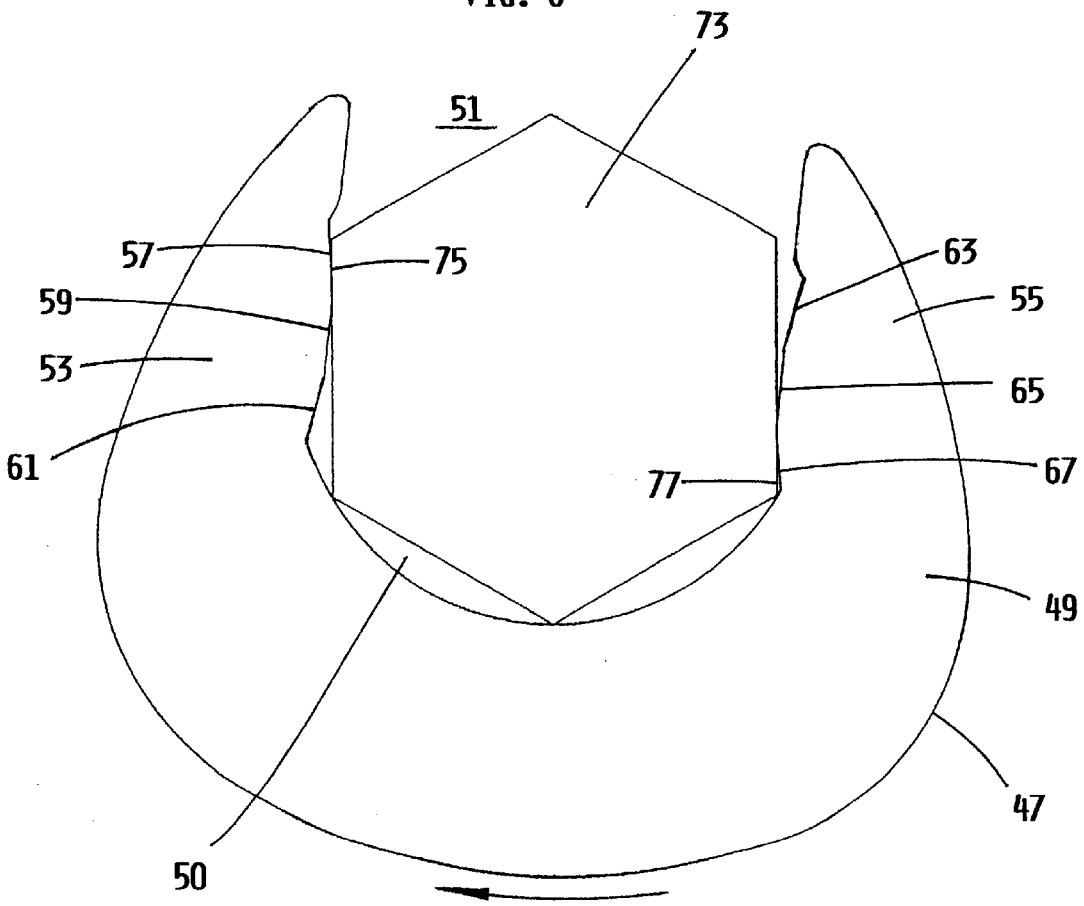
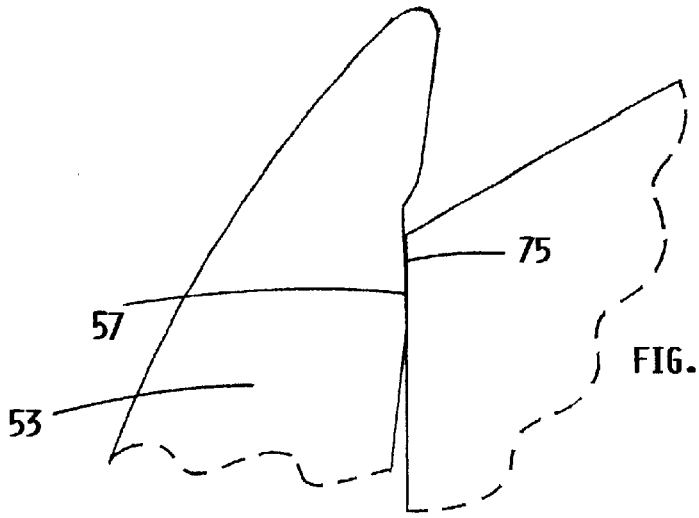
FIG. 7

OPEN END WRENCH WITH PINCH-LOCKING ENGAGING SURFACES

REFERENCES TO RELATED APPLICATIONS

This application relates to U.S. patent application entitled WRENCH WITH PINCH-LOCKING ENGAGING SURFACES, filed by the inventor herein, of which the application serial number and filing date are not known at the time of this filing.

FIELD OF THE INVENTION

The present invention relates to hand tools, particularly wrenches and most particularly open end type wrenches.

BACKGROUND OF THE INVENTION

An open end wrench is a wrench that has an open ended wrench head used to turn and control the rotation of bolts, nuts and various fasteners. Examples of open end wrenches include, but are not limited to, double open end, combination, flare nut, flex head etc. An open end wrench can access fasteners under certain limited-access conditions where a closed end or box wrench cannot, however, an open end wrench is much weaker by design than a box wrench. The weakness is associated with the inevitable jaw spread produced by the cam effect of fastener to wrench, under torque. This inherent weakness reduces torque capacity and promotes fastener deformation and wrench wear.

Subsequently, there have been numerous attempts to increase the strength and torque capacity of open end wrenches. The use of sharp teeth or serrations has been relatively effective on all but extremely hard fasteners, however, this technology sacrificed the fastener to gain additional torque by leaving bite or shred marks on the fastener. The use of inclined and arcuate driving surfaces has been effective at reducing the bite marks and fastener deformation, however, this technology has been generally less effective at increasing wrench strength and torque capacity. In addition, most prior attempts to improve the torque capacity of open end wrenches have consequently produced an increase in the total free play arc between wrench and fastener which applicant believes to be objectionable to most users.

SUMMARY OF THE INVENTION

The present invention involves a high torque, open end wrench head which when turned in either direction can provide a substantial increase in torque capacity while reducing fastener deformation and wrench wear.

The present invention more specifically involves a wrench head that has an open end for a fastener which has at least two substantially parallel outer engaging surfaces that create an across-width dimension. The wrench head has an orifice which comprises six principle internal engaging surfaces each being substantially flat and positioned around an imaginary central axis. The first, second and third internal engaging surfaces are positioned on a first jaw, and the fourth, fifth and sixth internal engaging surfaces are positioned on a second opposing jaw. The first internal engaging surface is positioned closer to the open end than the second internal engaging surface and diverges outward from the imaginary central axis. The second internal engaging surface is positioned closer to the open end than the third internal engaging surface and is substantially parallel to the imaginary central axis. The third internal engaging surface diverges outward from the imaginary central axis. The fourth internal engaging surface is positioned crosswise opposing the first internal engaging surface and diverges outward from the imaginary central axis. The fifth internal engaging surface is positioned crosswise opposing the second internal engaging surface and is substantially parallel to the imaginary central axis. The sixth internal engaging surface is positioned crosswise opposing the third internal engaging surface and diverges outward from the imaginary central axis. The second and fifth internal engaging surfaces are spaced apart by a dimension slightly greater than the across-width dimension of the fastener. The first and sixth internal engaging surfaces are spaced apart by a dimension slightly less than the across-width dimension of the fastener and the third and forth internal engaging surfaces are spaced apart by a dimension slightly less than the across-width dimension of the fastener.

The present invention has been developed recognizing the inevitable jaw spread of a standard open end wrench under torque and the subsequent need to increase wrench strength and torque while reducing fastener deformation and wrench wear. The present invention wrench, therefore, relies upon a predetermined amount of jaw spread to develop a "pinch locking" effect and substantial surface-to-surface engagement with a fastener during the torque process. In addition, the present invention has been developed recognizing the need to achieve such increases in performance without significantly increasing the total free play arc between wrench and fastener or precluding wrench head offset ("flip-flop") capability.

Accordingly, it is an important objective of the present invention described above to significantly increase the strength and torque capacity of an open end wrench head without sacrificing the fastener by leaving bite marks, shred marks or otherwise deforming the fastener.

It is another objective of the present invention to achieve the improved performance without significantly increasing the total free play arc between wrench and fastener and while maintaining the ability to flip the wrench over or "flip-flop" the wrench in limited access situations.

It is another objective of the present invention that it be commercially viable, simple in design, and cost efficient to manufacture.

BRIEF DESCRIPTION OF THE DRAWINGS

FIG. 4 shows a top plan view of another present invention wrench head turning clockwise on a hexagonal fastener also shown in a top plan view, without the application of torque;

FIG. 5 shows an enlargement of the upper left portion of the wrench head and fastener shown in FIG. 4;

FIG. 6 shows the present invention wrench head shown in FIGS. 4 and 5 with the wrench head also turning clockwise on the hexagonal fastener, but with the application of torque and subsequent jaw spread; and, FIG. 7 shows an enlargement of the upper left portion of the wrench and fastener shown in FIG. 6.

DETAILED DESCRIPTION OF THE DRAWINGS

Figure 1:
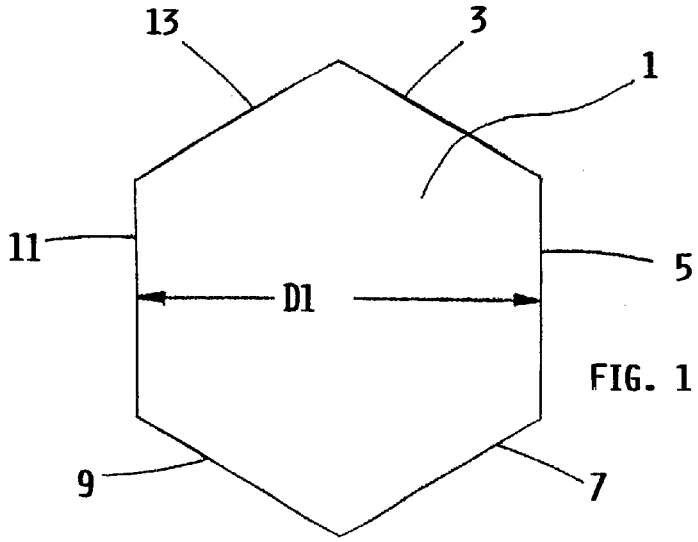
FIG. 1 shows a top plan view of a hexagonal fastener which has at least two, substantially parallel outer engaging surfaces.

Referring now to the drawings which are for the purpose of illustrating preferred embodiments of the present invention and not for the purpose of limiting same, FIG. 1 shows a hexagonal fastener 1 having six relatively flat outer engaging surfaces 3,5,7,9,11 and 13. Opposing outer surfaces are substantially parallel to each other, for example outer engaging surfaces 5 and 11 are substantially parallel to each other and create an across-width dimension D1. The across-width dimension represents the actual size of the fastener and not necessarily the nominal size of the fastener, and this dimension directly relates to the positioning and spacing of the principle internal engaging surfaces of the present invention wrench head shown in FIG. 2.

An internal engaging surface shall be defined herein as any engaging surface positioned within the wrench head orifice that may engage and interact with the external engaging surfaces of a fastener, nut, bolt etc. It is possible to have a single internal engaging surface comprising two or several adjacent surfaces aligned with one another and having the same angle relationship to the imaginary central axis or center line.

Figure 2:
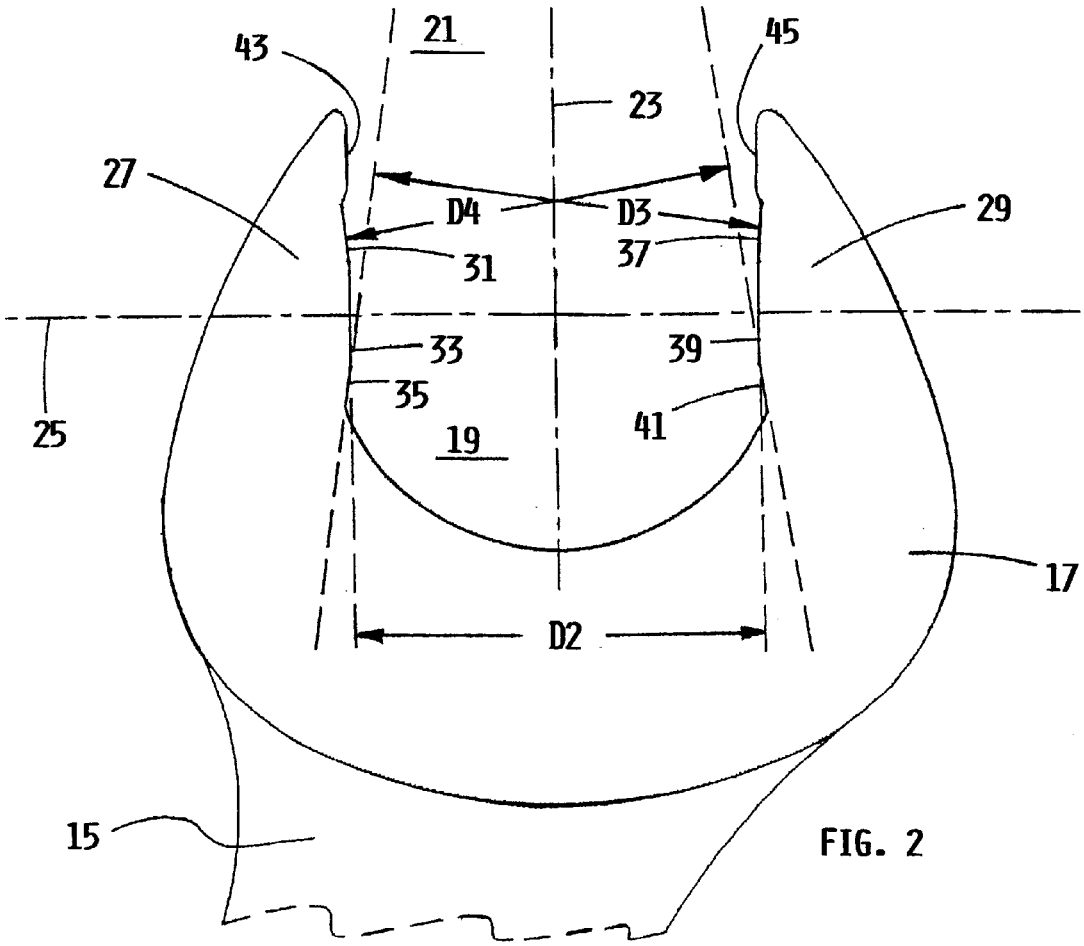
FIG. 2 shows a top plan, cut view of a wrench having a present invention wrench head for use with the hexagonal fastener shown in FIG. 1.

FIG. 2 shows a top plan, cut view of a wrench 15 with a present invention wrench head 17. Wrench head 17 is a one piece wrench head without any moving parts. Wrench head 17 includes orifice 19, open end 21 and six principle, internal engaging surfaces arranged around an imaginary central axis 23 and perpendicular cross-line 25. The "principle" internal engaging surfaces are the internal engaging surfaces of the wrench head which are of the greatest importance and which actually engage and interact with the fastener under torque, during normal operation. The present invention includes six principle internal engaging surfaces, and therefore, could have more than, but not less than six. A first jaw 27 has the first internal engaging surface 31, the second internal engaging surface 33 and the third internal engaging surface 35. The first internal engaging surface 31 is substantially flat and diverges outward from imaginary central axis 23 and is positioned closer to the open end 21 of wrench head 17 than the second internal engaging surface 33. The second internal engaging surface 33 is substantially flat and substantially parallel to imaginary central axis 23 and positioned closer to the open end 21 than the third internal engaging surface 35. The third internal engaging surface 35 is substantially flat and diverges outward from imaginary central axis 23. A second opposing jaw 29 has the fourth internal engaging surface 37, the fifth internal engaging surface 39 and the sixth internal engaging surface 41. The fourth internal engaging surface 37 is positioned crosswise opposing the first internal engaging surface 31 and is substantially flat and diverges outward form imaginary central axis 23. The fifth internal engaging surface 39 is positioned crosswise opposing the second internal engaging surface 33 and is substantially flat and substantially parallel to imaginary central axis 23, the sixth internal engaging surface 41 is positioned crosswise opposing the third internal engaging surface 35 and diverges outward from imaginary central axis 23. In this embodiment of the present invention, wrench head 17 also has a seventh internal engaging surface 43 and an eighth internal engaging surface 45 which together provide the wrench head with fastener tip engagement when the wrench head cannot be positioned properly on the bolt head, nut or fastener. It should be noted that the seventh and eighth internal engaging surfaces 43 and 45 respectively are not considered principle internal engaging surfaces as defined herein above, because these internal engaging surfaces do not actually engage and interact with the fastener under torque, during normal operation.

The second internal engaging surface 33 is substantially parallel to and spaced apart from the fifth internal engaging surface 39 by a dimension D2 which is slightly greater than the across-with dimension D1 of the corresponding fastener shown in FIG. 1. This allows wrench head 17 to slide onto and begin interaction with the intended fastener shown in FIG. 1. However, the third and fourth internal engaging surfaces 35 and 37 respectively are spaced apart by a dimension D3 which is intentionally less than the across-width dimension of the intended fastener. In fact, the intended fastener (1 shown in FIG. 1) can not parallel fit between driving surfaces 35 and 37 when wrench head 17 is at rest and not under torque. Also, the first and sixth internal engaging surfaces 31 and 41 respectively are spaced apart by a dimension D4 which is intentionally less than the across-width dimension of the intended fastener. In fact, the intended fastener (1 shown in FIG. 1) can not parallel fit between driving surfaces 31 and 41 when wrench head 17 is at rest and not under torque. It can be seen in this FIG. 2, and also FIG. 3 that imaginary central axis 23 and imaginary cross-line 25 together form four imaginary quadrants. Importantly, corresponding internal engaging surfaces 31 and 41 are each positioned within separate, diagonally opposed imaginary quadrants. Likewise, corresponding internal engaging surfaces 35 and 37 are each positioned within separate, diagonally opposed imaginary quadrants.

The jaws of all open end wrenches will flex and spread during the torque process. During this inevitable jaw flex and spread, great pressures are exerted between the inner engaging surfaces of the wrench and the outer engaging surfaces of the fastener. Accordingly, it is advantageous to spread this great pressure over as large an area as possible to minimize fastener and wrench deformation, and maximize torque. It is this anticipated jaw flex and spread between wrench jaws 27 and 29 which will allow the intended fastener (1 shown in FIG. 1) to parallel fit between and fully engage with driving surfaces 35 and 37 when wrench head 17 is turning counter-clockwise. Likewise, it is this anticipated jaw flex and spread between wrench jaws 27 and 29 which will allow the intended fastener (1 shown in FIG. 1) to parallel fit between and fully engage with driving surfaces 31 and 41 when wrench head 17 is turning clockwise. Thus, driving surfaces 35 and 37 do not achieve a parallel relationship and substantial surface-to-surface engagement with the outer engaging surfaces of the intended fastener while at rest, however, driving surfaces 35 and 37 can and do achieve a parallel relationship or substantial surface-to-surface engagement with the outer engaging surfaces of the intended fastener during the torque process and upon jaw flex and spread. Likewise, driving surfaces 31 and 41 do not achieve a parallel relationship and substantial surface-to-surface engagement with the outer engaging surfaces of the intended fastener while at rest, however, driving surfaces 31 and 41 can and do achieve a parallel relationship or substantial surface-to-surface engagement with the outer engaging surfaces of the intended fastener during the torque process and upon jaw flex and spread. In addition, engaging surfaces 35 and 37 actually provide a pinch-locking affect on the fastener, pinching the fastener between engaging surfaces 35 and 37 when wrench head 17 is rotated counter-clockwise in this view, and, engaging surfaces 31 and 41 actually provide a pinch-locking affect on the fastener, pinching the fastener between engaging surfaces 31 and 41 when wrench head 17 is rotated clockwise in this view. Again, engaging surfaces 35 and 37 are initially spaced apart less than the across-width dimension of the fastener but then conform to the exact across-width dimension of the fastener during the normal wrench flex and jaw spread created by torque. Likewise, engaging surfaces 31 and 41 are initially spaced apart less than the across-width dimension of the fastener but then conform to the exact across-width dimension of the fastener during the normal wrench flex and jaw spread created by torque.

Figure 3:
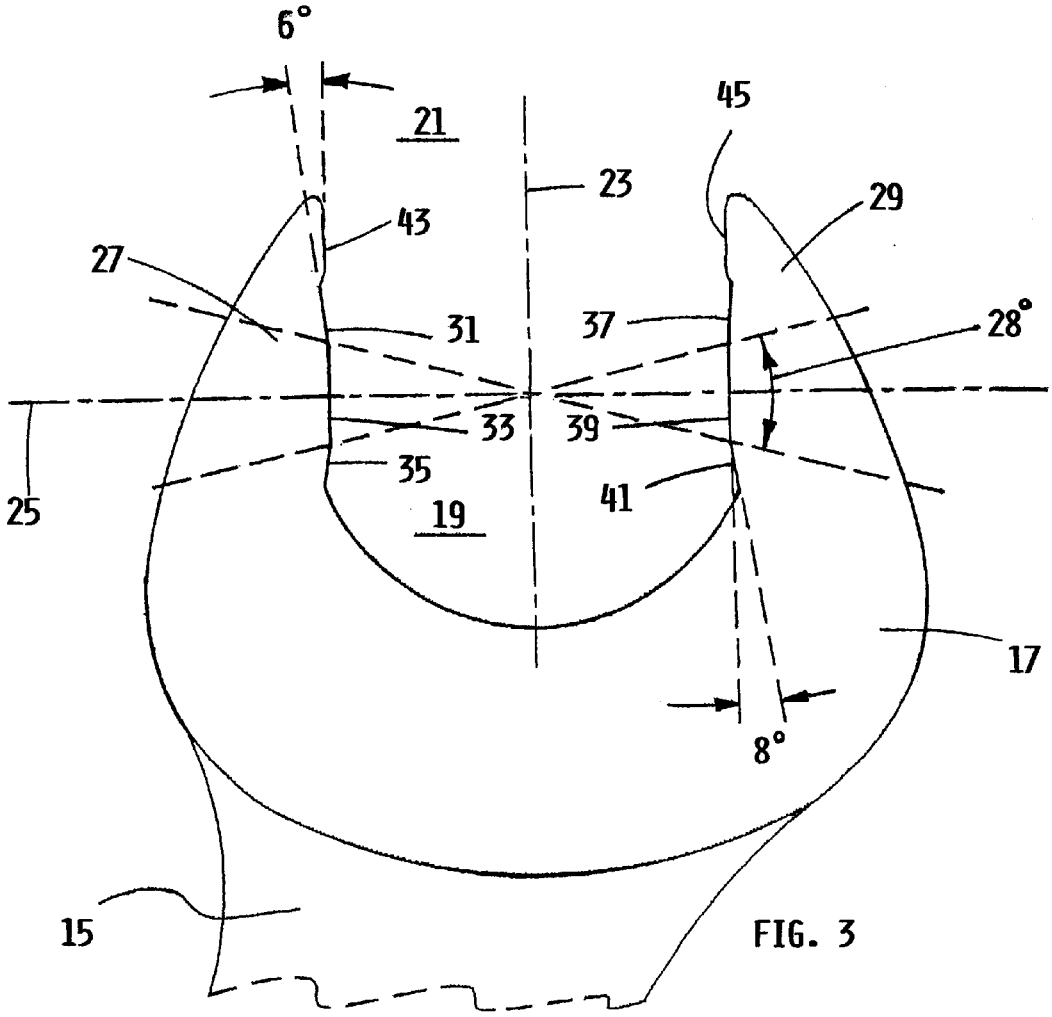
FIG. 3 shows a top plan, cut view of the wrench having the wrench head shown in FIG. 2 and showing additional details.

Referring now to FIG. 3 which shows the same wrench head as that shown in FIG. 2 with additional details including the angle relationship of internal engaging surfaces to the imaginary central axis. In this preferred embodiment of the present invention the first internal engaging surface 31 diverges outward from the imaginary central axis 23 at an angle of about 6 degrees. Likewise, the fourth internal engaging surface 37 diverges outward from the imaginary central axis 23 at angle of about 6 degrees. In preferred embodiments of the present invention, the first and fourth internal engaging surfaces 31 and 37 respectively, each diverge outward from the imaginary central axis at an angle within the range of 1 through 13 degrees. The angle could be slightly more or less but is preferably within that range. In more preferred embodiments of the present invention, the first and fourth internal engaging surfaces 31 and 37 respectively, each diverge outward from the imaginary central axis at an angle within the range of 4 through 10 degrees.

Also, in this preferred embodiment of the present invention the third internal engaging surface 35 diverges outward from the imaginary central axis 23 at an angle of about 8 degrees. Likewise, the sixth internal engaging surface 41 diverges outward from the imaginary central axis 23 at angle of about 8 degrees. In preferred embodiments of the present invention, the third and sixth internal engaging surfaces 35 and 41 respectively, each diverge outward from the imaginary central axis at an angle within the range of 1 through 13 degrees. The angle could be slightly more or less but is preferably within that range. In more preferred embodiments of the present invention, the third and sixth internal engaging surfaces 35 and 41 respectively, each diverge outward from the imaginary central axis at an angle within the range of 4 through 10 degrees. The angles at which the first, third, fourth and sixth internal engaging surfaces diverge outward from the imaginary central axis 23 are critical, structural features of the present invention developed through comprehensive testing and which provide increased wrench performance but only a minimal increase in free play arc between wrench and fastener. In preferred embodiments of the present invention, it is desirable to have the third and sixth internal engaging surfaces 35 and 41 each, diverge outward from the imaginary central axis 23 at an angle greater than the angle at which the first and fourth internal engaging surfaces 31 and 37 each, diverge outward from the imaginary central axis. Subsequently, the first and fourth internal engaging surfaces may be slightly longer than the third and sixth internal engaging surfaces as shown. Such an arrangement is desirable because when jaws 27 and 29 flex and spread under torque, the spread is always the greatest at the open end 21 of wrench head 17. The present invention involves engaging surfaces which are positioned with certain specific angles and spacing dimensions which are the result of comprehensive testing. Accordingly, these angles and spacing dimensions are critical structural features which collectively have a profound affect on toque capacity, fastener deformation, and, free play arc between wrench and fastener. In a field of saturated prior art, the specific angles and spacing dimensions of the present invention provide the critical structural differences necessary to achieve the objectives set forth in this application.

As defined earlier, the second and fifth internal engaging surfaces 33 and 39 are each parallel the imaginary central axis and are as shown in this FIG. 3 and FIG. 2, about equal in length relative to each other. The length of each, however, is very important, and structurally significant. Comprehensive testing, has proven that when the lengths of the second and fifth internal engaging surfaces 33 and 39 are too short, the wrench exhibits excessive free play arc with a fastener; and, when the lengths of the second and fifth internal engaging surfaces 33 and 39 are too long, the additional torque and strength is minimized. Accordingly, applicant has determined that it is best to have the length of the second and fifth internal engaging surfaces 33 and 39 be relative to an imaginary angle originating from the center of orifice 19 (or at the intersection point of the imaginary central axis 23 and imaginary cross line 25). As shown, the length of each is relative to an imaginary angle originating from the center of the orifice 19, and the angle is within the range of 18 through 38 degrees. This imaginary angle could be slightly more or less, however, it is preferably within that range. In this preferred embodiment, the length of the second internal engaging surface 33 is determined by an imaginary angle originating at the center of orifice 19 and that angle is 28 degrees as shown in this view. Likewise, the length of the fifth internal engaging surface 39 is determined by an imaginary angle originating at the center of orifice 19 and that angle is 28 degrees as shown in this view.

Again, the present invention involves engaging surfaces which are positioned with certain specific angles and spacing dimensions which are the result of comprehensive testing. Accordingly, these angles and spacing dimensions are critical structural features which collectively have a profound effect on torque capacity, fastener deformation, and, free play arc between wrench and fastener. In a saturated field of prior art, the specific angles and spacing dimensions of the present invention provide the critical structural differences necessary to achieve the objectives set forth in this application.

Referring to FIGS. 4 and 5, FIG. 4 shows a top plan view of another present invention wrench head turning clockwise on a hexagonal fastener also shown in a top plan view, without the application of torque; and, FIG. 5 shows an enlargement of the upper left portion of the wrench head and fastener shown in FIG. 4. In these FIGS. 4 and 5 there is shown a wrench 47 with a present invention wrench head 49 having an orifice 50 and an open end 51. Wrench head 49 has six principle internal engaging surfaces 57, 59, 61, 63, 65 and 67 and is turning clockwise upon a fastener 73 without the application of torque and without jaw flex or spread. In these two FIGS. 4 and 5, it is clear to see that internal engaging surface 57 does not achieve a parallel relationship with corresponding fastener engaging surface 75. Likewise, it is clear to see that internal engaging surface 67 does not achieve a parallel relationship with corresponding fastener engaging surface 77. In fact, it is physically impossible for driving surfaces 57 and 67 to achieve a parallel and substantial surface-to-surface engagement with their corresponding fastener engaging surfaces 75 and 77 respectively, unless jaws 53 and 55 were spread apart. The same effect is realized and achieved if wrench head 49 were to be turned in an opposite or counter-clockwise direction.

Referring now to FIGS. 6 and 7, FIG. 6 shows the present invention wrench head shown in FIGS. 4 and 5 with the wrench head also turning clockwise on the hexagonal fastener, but with the application of torque and subsequent jaw spread; and, FIG. 7 shows an enlargement of the upper left portion of the wrench head and fastener shown in FIG. 6. Accordingly, FIGS. 6 and 7 are numbered the same as shown in FIGS. 4 and 5. With jaws 53 and 55 slightly spread apart, driving surface 57 is now able to achieve a parallel relationship and substantial surface-to-surface engagement with fastener engaging surface 75. Likewise and simultaneously, driving surface 67 is now able to achieve a parallel relationship and substantial surface-to-surface engagement with fastener engaging surface 77. Again, this type of substantial surface-to-surface engagement (while under torque) is very desirable because it distributes the great pressures between wrench and fastener over a larger area, increasing torque capacity while reducing fastener deformation and wrench wear. In this view, fastener 73 is actually being forced and squeezed between driving surfaces 57 and 67, thereby creating a pinch-locking effect and significantly increasing the performance of wrench head 49. The same effect is realized and achieved if wrench head 49 were to be turned in an opposite or counter-clockwise direction which would then employ the use of engaging surfaces 61 and 63.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A one piece, wrench head having an open end for a fastener having at least two substantially parallel outer engaging surfaces creating an across-width dimension; said wrench head having an orifice comprising six principle internal engaging surfaces each being substantially flat and positioned around an imaginary central axis with the first, second and third internal engaging surfaces being positioned on a first jaw, and the fourth, fifth and sixth internal engaging surfaces being positioned on a second opposing jaw, said first internal engaging surface being positioned closer to said open end than said second internal engaging surface and diverging outward from said imaginary central axis, said second internal engaging surface being positioned closer to said open end than said third internal engaging surface and being substantially parallel to said imaginary central axis, said third internal engaging surface diverging outward from said imaginary central axis, said fourth internal engaging surface being positioned crosswise opposing said first internal engaging surface and diverging outward from said imaginary central axis, said fifth internal engaging surface being positioned crosswise opposing said second internal engaging surface and being substantially parallel said imaginary central axis, said sixth internal engaging surface being positioned crosswise opposing said third internal engaging surface and diverging outward from said imaginary central axis, and, said second and fifth internal engaging surfaces being spaced apart by a dimension slightly greater than the across-width dimension of said fastener, said first and sixth internal engaging surfaces being spaced apart by a dimension slightly less than the across-width dimension of said fastener and said third and forth internal engaging surfaces being spaced apart by a dimension slightly less than the across-width dimension of said fastener.

2. A wrench head of claim 1, wherein said first, third, fourth and sixth internal engaging surfaces each diverge outward from said imaginary central axis at an angle within the range of 1 through 13 degrees.

3. A wrench head of claim 1, wherein the length of said second and fifth internal engaging surfaces is each relative to an imaginary angle originating from the center of said orifice, and said angle is within the range of 18 through 38 degrees.

4. A wrench head of claim 1, wherein said third and sixth internal engaging surfaces each diverge outward from said imaginary central axis at an angle greater than an angle at which each of said first and fourth internal engaging surfaces diverge outward from said imaginary central axis.

5. A wrench head of claim 1, wherein each of said internal engaging surfaces have a predetermined length and said first and fourth internal engaging surfaces each have a length slightly longer than the lengths of said third and sixth internal engaging surfaces.

6. A wrench head of claim 1, wherein said orifice includes a seventh internal engaging surface that is substantially parallel said imaginary central axis and positioned on the first jaw and closer to the open end of said wrench head than said first internal engaging surface, and, an eighth internal engaging surface that is substantially parallel said imaginary central axis and positioned on the second jaw and closer to the open end of said wrench head than said fourth internal engaging surface.

7. A wrench head of claim 2, wherein the length of said second and fifth internal engaging surfaces is each relative to an imaginary angle originating from the center of said orifice, and said angle is within the range of 18 through 38 degrees.

8. A wrench head of claim 2, wherein said third and sixth internal engaging surfaces each diverge outward from said imaginary central axis at an angle greater than an angle at which each of said first and fourth internal engaging surfaces diverge outward from said imaginary central axis.

9. A wrench head of claim 2, wherein each of said internal engaging surfaces have a predetermined length and said first and fourth internal engaging surfaces each have a length slightly longer than the lengths of said third and sixth internal engaging surfaces.

10. A wrench head of claim 2, wherein said orifice includes a seventh internal engaging surface that is substantially parallel said imaginary central axis and positioned on the first jaw and closer to the open end of said wrench head than said first internal engaging surface, and, an eighth internal engaging surface that is substantially parallel said imaginary central axis and positioned on the second jaw and closer to the open end of said wrench head than said fourth internal engaging surface.

11. A one piece, wrench head having an open end for a fastener having at least two substantially parallel outer engaging surfaces creating an across-width dimension; said wrench head having an orifice comprising six principle internal engaging surfaces each being substantially flat and positioned around an imaginary central axis with the first, second and third internal engaging surfaces being positioned on a first jaw, and the fourth, fifth and sixth internal engaging surfaces being positioned on a second opposing jaw, said first internal engaging surface being positioned closer to said open end than said second internal engaging surface and diverging outward from said imaginary central axis at an angle within the range of 1 through 13 degrees, said second internal engaging surface being positioned closer to said open end than said third internal engaging surface and being substantially parallel to said imaginary central axis, said third internal engaging surface diverging outward from said imaginary central axis at an angle within the range of 1 through 13 degrees, said fourth internal engaging surface being positioned crosswise opposing said first internal engaging surface and diverging outward from said imaginary central axis at an angle within the range of 1 through 13 degrees, said fifth internal engaging surface being positioned crosswise opposing said second internal engaging surface and being substantially parallel said imaginary central axis, said sixth internal engaging surface being positioned crosswise opposing said third internal engaging surface and diverging outward from said imaginary central axis at an angle within the range of 1 through 13 degrees, and, said second and fifth internal engaging surfaces being spaced apart by a dimension slightly greater than the across-width dimension of said fastener, said first and sixth internal engaging surfaces being spaced apart by a dimension slightly less than the across-width dimension of said fastener and said third and forth internal engaging surfaces being spaced apart by a dimension slightly less than the across-width dimension of said fastener.

12. A wrench head of claim 11, wherein the length of said second and fifth internal engaging surfaces is each relative to an imaginary angle originating from the center of said orifice, and said angle is within the range of 18 through 38 degrees.

13. A wrench head of claim 11, wherein said third and sixth internal engaging surfaces each diverge outward from said imaginary central axis at an angle greater than the angle at which said first and fourth internal engaging surfaces each diverge outward from said imaginary central axis.

14. A wrench head of claim 11, wherein each of said internal engaging surfaces have a predetermined length and said first and fourth internal engaging surfaces each have a length slightly longer than the lengths of said third and sixth internal engaging surfaces.

15. A wrench head of claim 11, wherein said orifice includes a seventh internal engaging surface that is substantially parallel said imaginary central axis and positioned on the first jaw and closer to the open end of said wrench head than said first internal engaging surface, and, an eighth internal engaging surface that is substantially parallel said imaginary central axis and positioned on the second jaw and closer to the open end of said wrench head than said fourth internal engaging surface.

16. A wrench head of claim 12, wherein said third and sixth internal engaging surfaces each diverge outward from said imaginary central axis at an angle greater than the angle at which said first and fourth internal engaging surfaces each diverge outward from said imaginary central axis.

17. A wrench head of claim 12, wherein each of said internal engaging surfaces have a predetermined length and said first and fourth internal engaging surfaces each have a length slightly longer than the lengths of said third and sixth internal engaging surfaces.

18. A wrench head of claim 12, wherein said orifice includes a seventh internal engaging surface that is substantially parallel said imaginary central axis and positioned on the first jaw and closer to the open end of said wrench head than said first internal engaging surface, and, an eighth internal engaging surface that is substantially parallel said imaginary central axis and positioned on the second jaw and closer to the open end of said wrench head than said fourth internal engaging surface.

19. A wrench head of claim 13, wherein each of said internal engaging surfaces have a predetermined length and said first and fourth internal engaging surfaces each have a length slightly longer than the lengths of said third and sixth internal engaging surfaces.

20. A wrench head of claim 13, wherein said orifice includes a seventh internal engaging surface that is substantially parallel said imaginary central axis and positioned on the first jaw and closer to the open end of said wrench head than said first internal engaging surface, and, an eighth internal engaging surface that is substantially parallel said imaginary central axis and positioned on the second jaw and closer to the open end of said wrench head than said fourth internal engaging surface.

* * * * *